US007104524B1

(12) United States Patent
Hidding et al.

(10) Patent No.: US 7,104,524 B1
(45) Date of Patent: Sep. 12, 2006

(54) VEHICLE RAMP WITH CHOCK

(75) Inventors: David E. Hidding, Barrington, IL (US); Thomas J. Braun, Crystal Lake, IL (US); Richard W. Del Olmo, Barrington, IL (US)

(73) Assignee: Davric Corporation, Inc., Crystal Lake, IL (US)

( * ) Notice: Subject to any disclaimer, the term of this patent is extended or adjusted under 35 U.S.C. 154(b) by 0 days.

(21) Appl. No.: 11/276,018

(22) Filed: Feb. 9, 2006

(51) Int. Cl.
*E02C 3/00* (2006.01)

(52) U.S. Cl. ..... 254/88; 14/69.5

(58) Field of Classification Search ..... 254/88, 254/50; 14/69.5
See application file for complete search history.

(56) References Cited

U.S. PATENT DOCUMENTS

| | | | | |
|---|---|---|---|---|
| 1,922,555 | A | 8/1933 | McCosh | |
| 3,734,241 | A | 5/1973 | Hale | |
| 3,870,277 | A | 3/1975 | West | |
| 3,873,064 | A | 3/1975 | Lundman | |
| 4,031,939 | A | 6/1977 | De Martini | |
| 4,920,596 | A | 5/1990 | Stevens | |
| 5,176,361 | A | 1/1993 | Ayala, III | |
| 5,269,036 | A | 12/1993 | Yan et al. | |
| 5,427,209 | A | 6/1995 | Tannehill et al. | |
| 5,446,937 | A | 9/1995 | Haskins | |
| 5,483,715 | A | 1/1996 | Fogarty et al. | |
| 5,863,026 | A | 1/1999 | Gano et al. | |
| 6,439,543 | B1 * | 8/2002 | Peckham | 254/88 |
| 6,517,051 | B1 * | 2/2003 | Cavanaugh | 254/88 |
| 6,672,968 | B1 * | 1/2004 | Montolio | 472/89 |
| 6,718,588 | B1 * | 4/2004 | Frederiksen | 14/69.5 |
| 6,993,801 | B1 * | 2/2006 | Marko et al. | 14/69.5 |
| 7,003,836 | B1 * | 2/2006 | Berg | 14/69.5 |
| 2005/0000042 | A1 | 1/2005 | Marko et al. | |
| 2005/0132511 | A1 | 6/2005 | Berg | |

* cited by examiner

*Primary Examiner*—Lee D. Wilson
(74) *Attorney, Agent, or Firm*—Barnes & Thornburg LLP; Timothy J. Engling

(57) ABSTRACT

A vehicle ramp for raising a vehicle wheel having an incline component and a separate but interlockable elevated wheel support component. The incline component can be removed while the vehicle wheel is resting on the corresponding elevated wheel support component. The elevated wheel support component has an adjustable chock. In addition to a rear stop on an end, a chock with a raised section helps keep the vehicle wheel from rolling off the top horizontal surface. The removal of the incline component while the vehicle rests on the elevated wheel support component is accomplished with an interlocking member that does not extend the entire height of the interlocking sides of the primary components. Hand grips or handles can be formed in recesses of the sides of each component.

15 Claims, 3 Drawing Sheets

VEHICLE RAMP WITH CHOCK

BACKGROUND

The present disclosure relates to vehicle ramps having an interlockable incline component and an elevated wheel support component. More particularly, the disclosure relates to plastic ramps having interlockable components wherein the incline component can be removed while the vehicle wheel is resting on the corresponding elevated wheel support component having an adjustable chock.

Vehicle ramps are used to support wheels of a vehicle elevated above a ramp support surface, such as paved ground, to provide easier access to the underside of the vehicle. Typically, vehicle ramps are used in pairs in conjunction with each wheel on the same axle of a vehicle. Ramps for raising vehicles to be serviced are generally portable. Such ramps are preferably easy to assemble and disassemble to reduce the amount of space for storage. As an alternative to metal ramps, plastic ramps are available that are relatively light-weight, yet strong.

Plastic ramps upon which a vehicle can be rolled or driven to elevate the vehicle are known in the art. An injection-molded plastic ramp with interlockable components using a pin and groove arrangement is known. The undersides of the primary interlockable components have been made with polygonal patterns to handle the stress and spread the load from the weight of a vehicle across a wider area of the ground. One component has a portion substantially parallel to, but elevated above, the ramp support surface, such as the ground. A second component includes an incline for the vehicle to roll up to reach on the elevated portion.

U.S. patent application Ser. No. 10/739,782 for "Portable Car Ramp," which was published on Jun. 23, 2005 as Publication No. 2005/0132511, discloses a portable car ramp with two major components: an inclined wheel run 20 and an elevated wheel run 50, with a specific unitary friction pad 37. These structural components 20 and 50 each have thereon respective generally planar bottom edges 23 and 53. Cooperating pin and groove formations 22 and 52, angled generally normal to the bottom edges of the respective components, are operable with limited clearances there between to telescope and to interlock the components together against movement in the direction of the elevated wheel run. The interlocking cooperating pins extend the height of the inner side "precluding attempted component disassembly when in use." Pads fixed to the second component bottom edge increase resistance against ramp sliding along the supporting surface, particularly with the wheel supported on the inclined wheel run.

U.S. Pat. No. 5,483,715 discloses a unitary vehicle service ramp having an external structure including a rear wall, a pair of side walls and a front. The front includes a surface sloping toward a top surface. The ramp has an internal structure forming a honeycomb pattern of supporting walls extending between said rear wall, side walls and front with a system of interlocking members serving as support members with individual members running longitudinally and transversely.

U.S. Pat. No. 1,922,555 discloses a platform section that attaches and separates from an incline, which may have a mat. Other prior art patents, such as U.S. Pat. Nos. 5,269,036 and 5,427,209, have abutment plates and/or stops on each end.

SUMMARY

The present disclosure relates to a plastic ramp structure upon which a vehicle can be rolled to elevate the vehicle. In an illustrative embodiment, the ramp is an injection-molded plastic ramp that includes two primary molded components that interlock and separate using a preferred pin and groove arrangement. The primary components are an elevated wheel support component and an incline component. The undersides of the primary components have polygonal patterns to handle the stress and spread the load from the weight of a vehicle.

In addition to the integral rear stop at the end of the ramp, a raised chock is used to prevent the wheel of a vehicle from rolling off the horizontal portion. The wheel chock can be rotated upward, or it can be a spring-loaded lineal piece.

Another improvement between the present ramps and the disclosure of U.S. Patent Application Publication No. 2005/0132511 is that the incline component of the ramp can be removed while the vehicle is resting on the raised horizontal surface of the elevated wheel support component. The "easy removal of the incline component while in while the vehicle rests on the elevated wheel support component" is accomplished with a shorter pin in a preferred pin and groove arrangement or a similar structure that does not extend the entire height of the interlocking sides of primary components.

Hand grips or handles can be formed in recesses of the sides of each component. Hand grips are preferably formed in a recess on each side with the outer wall having a recessed inner wall closer to the preferred load area in the center of the top surfaces of each component. The inner walls of the side handles also can reinforce the center of the raised platform where the wheel rests.

Patent Application Publication No. 2005/0132511 does not disclose improvements found in the proposed ramp design including the disclosed chock, the pin design to permit easier removal of the incline, and the recessed side handles that reinforce the center of the raised platform.

BRIEF DESCRIPTION OF THE DRAWING

The features of this disclosure and the manner of obtaining them will become more apparent, and the disclosure itself will be best understood by reference to the following description of embodiments of the ramp in conjunction with the accompanying drawings, wherein.

DETAILED DESCRIPTION

While the present invention will be fully described hereinafter with reference to the accompanying drawings, in which particular embodiments are shown, it is to be understood at the outset that persons skilled in the art may modify the embodiments disclosed herein while still achieving the desired results. Accordingly, the description that follows is to be understood as a broad informative disclosure directed to persons skilled in the appropriate art and not as limitations of the present disclosure.

Figure 1:
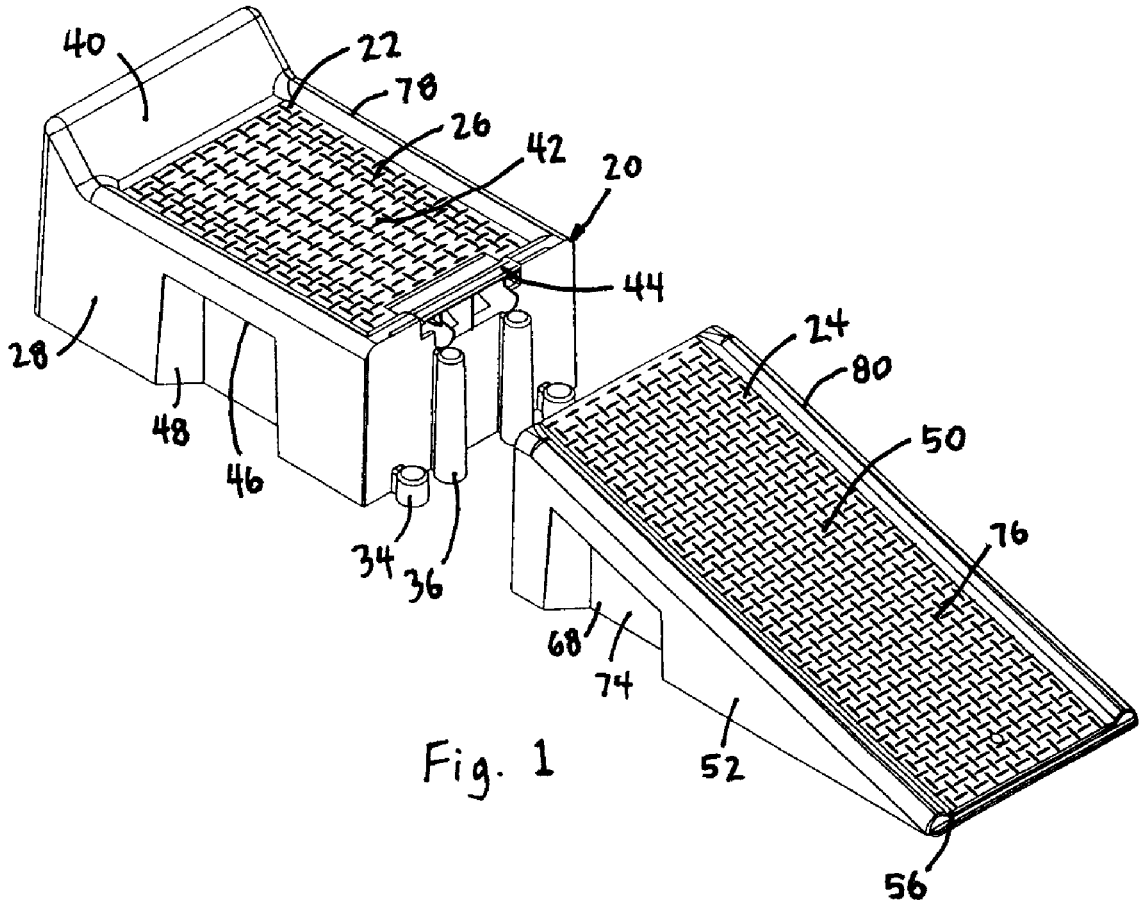
FIG. 1 shows a perspective view of a ramp with an incline component and an elevated wheel support component separated.
Figure 8:
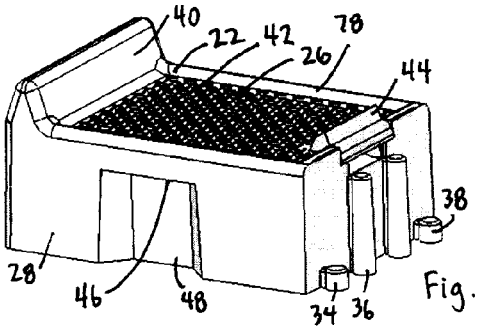
FIG. 8 shows a perspective view of a ramp with an incline component and an elevated wheel support component separated.

In the Figures, like reference numerals indicate the same elements throughout. FIGS. 1 and 8 each show a ramp 20 having an elevated wheel support component 22 and a separate incline component 24. While these structural components 22 and 24 can interlock, the incline component 24 can be removed while a vehicle wheel is resting on the elevated wheel support component 22.

The ramp 20 can be made of a variety of materials. Ideally, the ramp 20 is made of molded plastic with the preferred construction being a durable thermal plastic. The components are preferably injection molded from polypropylene or linear low-density PE (LLDPE). Other plastics employed in injection molding processes may include polyolefin, including the preferred PE and polypropylene (PP), polyvinyl-chloride (PVC), polycarbonates, and nylon. These plastics can be used with a variety of resins and additives to meet particular needs or desires for the ramp 20 and the environment in which the ramp 20 will be used. The ramp 20 is not intended to be made of a foamed plastic or even metal, but this disclosure is not meant to preclude such.

Figure 2:
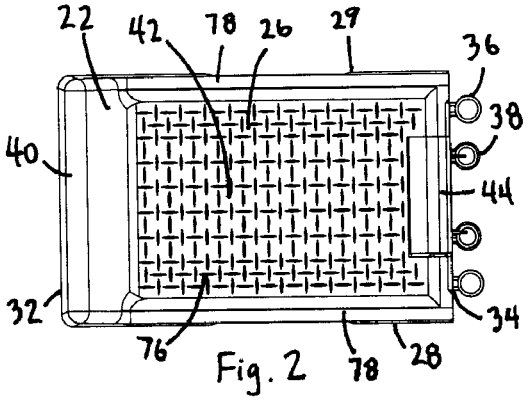
FIG. 2 shows a top view of an elevated wheel support component of a ramp.
Figure 4:
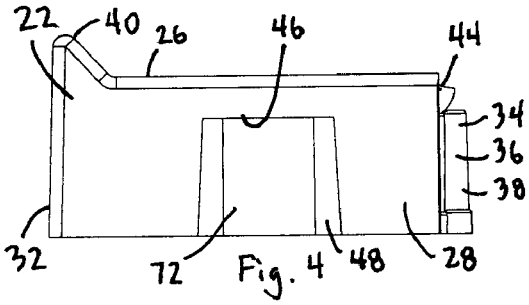
FIG. 4 shows a side view of an elevated wheel support component of a ramp.
Figure 6:
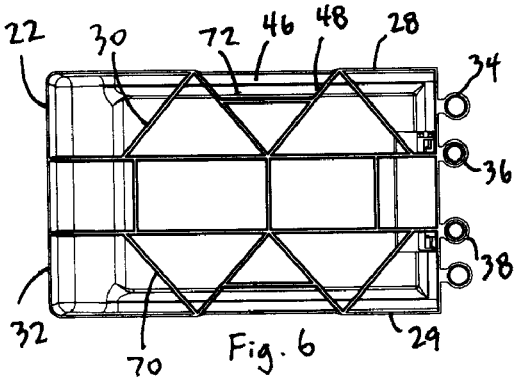
FIG. 6 shows a bottom view of an elevated wheel support component of a ramp.
Figure 9:
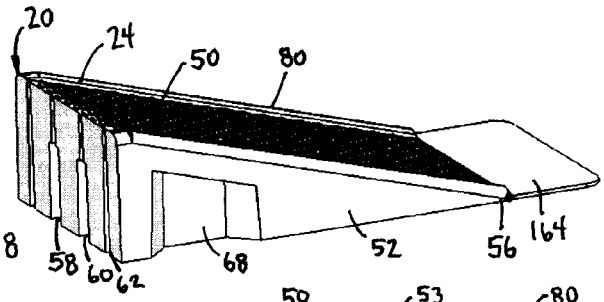
FIG. 9 shows a top view of an elevated wheel support component of a ramp.
Figure 9:
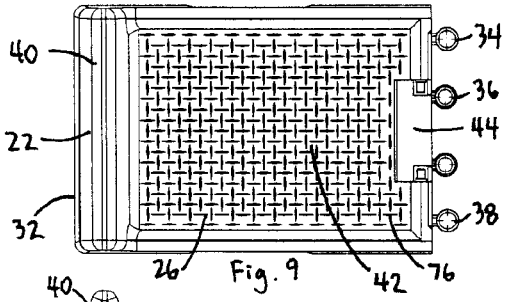
Figure 11:
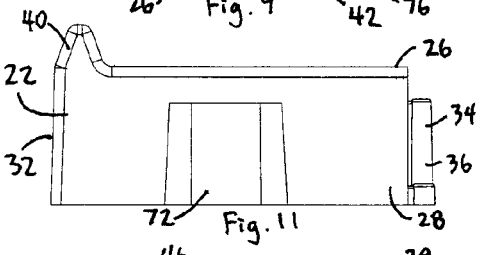
FIG. 11 shows a side view of an elevated wheel support component of a ramp.
Figure 13:
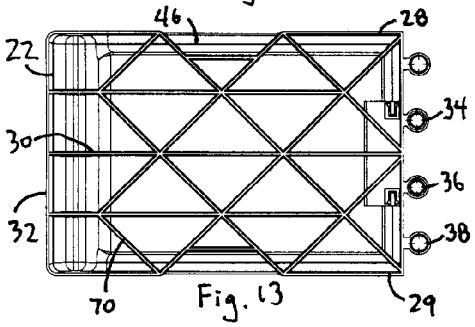
FIG. 13 shows a bottom view of an elevated wheel support component of a ramp.

The elevated wheel support component 22 has a top surface 26 (per FIGS. 2 and 9), two side surfaces 28 and 29, of which one side 28 is shown in FIGS. 4 and 11, a bottom portion 30 (per FIGS. 6 and 13), a rear surface 32, and an interlocking portion 34. The interlocking portion 34 includes interlocking members 36, such as pins 38 with four shown in the figures. The elevated wheel support component 22 includes an integral wheel stop 40 adjacent to the rear surface 32 extending above the wheel rest surface 42. The wheel stop 40 preferably includes a flat extension of the rear surface 32, as shown in FIG. 4, so component 22 can be stored in a stable manner on rear surface 32. But the wheel stop 40 may taper inwardly from the rear surface 32 as shown in FIG. 11. The elevated wheel support component 22 has a chock 44 adjacent to the interlocking portion 34 that pivots or slides above the wheel rest surface 42. Each side surface 28 and 29 preferably has a handle 46 located in a recessed portion 48.

Figure 3:
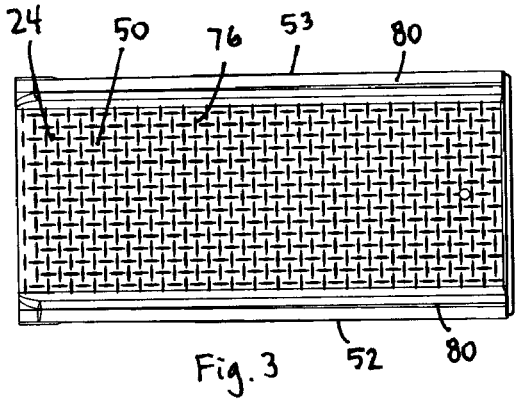
FIG. 3 shows a top view of an incline component of a ramp.
Figure 5:
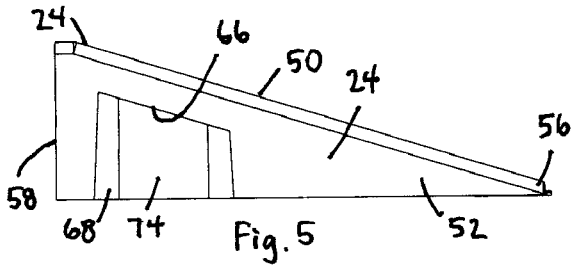
FIG. 5 shows a side view of an incline component of a ramp.
Figure 10:
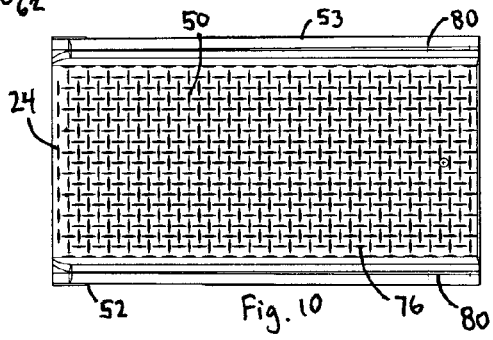
FIG. 10 shows a top view of an incline component of a ramp.
Figure 12:
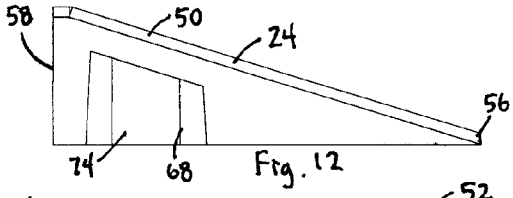
FIG. 12 shows a side view of an incline component of a ramp.
Figure 14:
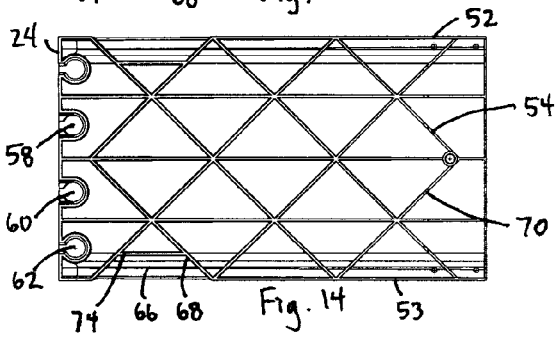
FIG. 14 shows a bottom view of an incline component of a ramp.

The incline component 24 has an inclined surface 50 (per FIGS. 3 and 10), two side surfaces 52 and 53, of which one side 52 is shown in FIGS. 5 and 12, a bottom portion 54 (per FIGS. 7 and 14), a tapered thin edge 56 (at a distal end), and an interlocking portion 58. The interlocking portion 58 includes interlocking members 60, such as grooves 62 with four shown in the figures. The inclined component 24 preferably includes a mat 64 adjacent to the tapered thin edge 56. Each side surface 52 and 53 preferably has a handle 66 in a recessed portion 68.

The elevated wheel support component 22 and the incline component 24 are designed to removably interlock by use of the interlocking member 36 of the interlocking portion 34 of the elevated wheel support component 22 in cooperation with the interlocking member 60 of the interlocking portion 58 of the incline component 24. In the preferred pin (38) and groove (62) arrangement, the pins 38 and grooves 62 are longitudinally aligned. Either component 22 or 24 could have pins 38 with the other having grooves 62 that are complementary. The corresponding pins 38 and grooves 62 can be conical, or the pin 38 can be T-shaped with a corresponding T-shaped connecting groove 62, as shown in FIGS. 18 and 19 of U.S. Patent Application Publication US 2005/0000042 A1, which is incorporated herein by reference. The interlocking member 36 does not extend the entire height of the interlocking portion 34 of elevated wheel support component 22. The removal of the incline component 24 while in use can be accomplished with shorter pins 38 in a preferred pin 38 and groove 62 arrangement or a similar structure that does not extend the entire height of one of the interlocking portions (34 or 58) of primary components 22 or 24 respectively. The preferred conical cooperating telescoping pin 38 and groove 62 allow the primary components 22 and 24 to interlock, but the incline component 24 can be readily removed due to the reduced height of the interlocking member 36, such as while a vehicle wheel rests on the elevated wheel support component 22. The ability to remove the incline component 24 allows greater access under the elevated vehicle (with a vehicle is resting on the wheel rest surface 42 of the wheel support component 22).

The removable incline component 24 can also be made longer with a more gradual incline for easier rolling up the inclined surface 50 since it can be removed to provide clearance and access underneath the vehicle where the incline component 24 had been. Safety is important for access under the elevated vehicle when it rests on the elevated wheel support component 22.

To prevent the vehicle from rolling off the wheel support component 22, the chock 44 when having a section extending above the wheel rest surface 42 forms an impediment to obstruct the vehicle wheel from rolling off the wheel rest surface 42 of the elevated wheel support component 22. The chock 44 can pivot or slide above the wheel rest surface 42 adjacent to the interlocking portion 34. The wheel chock 44 can be rotated or pivoted upward, or it can be a spring-loaded lineal piece. The chock 44 can also be biased or spring-loaded so that at least a section of the chock 44 automatically pivots or slides above the wheel rest surface 42 when the incline component 24 is removed from the elevated wheel support component 22. The chock 44 works in conjunction with the wheel stop 40 to help keep the vehicle wheel from rolling off the wheel rest surface 42.

The undersides 30 and 54 of the two interlockable components 22 and 24 have polygonal patterns 70 to handle the stress and spread the load from the weight of a vehicle. The bottom edges of the undersides 30 and 54, including the polygonal patterns 70, preferably engage the ground.

Like each side surface 28 and 29 of the elevated wheel support component 22, each side surface 52 and 53 of the incline component 24 preferably has a handle 66 located in a recessed portion 68. Handles 46 and 66 preferably form hand grips in the recessed portions 48 and 68 on each side. The inner recessed wall 72 of the elevated wheel support component 22 is closer to the preferred load area of the wheel rest surface 42. Similarly, the inner recessed wall 74 of the incline portion 24 is closer to the preferred stressed area, such as a center, of the inclined surface 50 as the vehicle wheel rolls up the incline portion 24.

Figure 7:
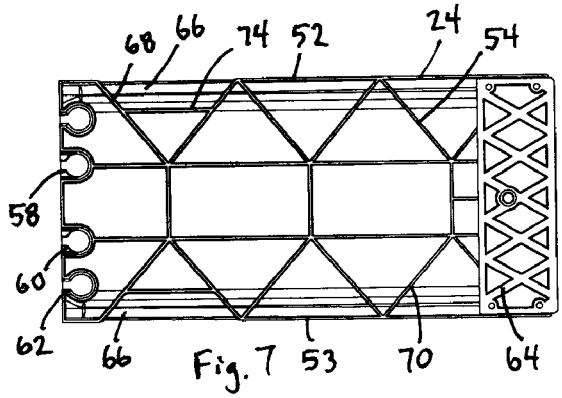
FIG. 7 shows a bottom view of an incline component of a ramp.

The incline component 24 may have a mat 64 with or without a portion extending away from the incline component 24. As shown in FIG. 7, the mat 64 may substantially be adjoining or contiguous with the incline component 24. The mat 64 can be formed of a compressible durable high friction material, such as rubber. A component, such as a mat 64, attached at the bottom of the incline component 24 can assist in maintaining the ramp's position when a vehicle is rolled onto the ramp 20. The mat 64 may be multiple pieces.

A friction pad or mat 164 may also be pivotally attached to the tapered thin edge 56 of the incline component 24 to pivot and extend away from the incline component 24. When extended, the mat 164 would allow the vehicle to engage the mat 164 before rolling up the inclined surface 50 to reduce potential sliding of the incline component 24 along the ground. Ideally, both types of mats, 64 and 164, are permanently attached so they are not lost during moving or storing the ramp 20.

The top surface 26 of the elevated wheel support component 22 and the inclined surface 50 of the incline component 24 preferably have textured patterns 76 molded into those surfaces (26 and 50) to assist with traction for the vehicle tire when moving on those surfaces 26 and 50.

The top surface 26 of the elevated wheel support component 22 may have lips 78 on each side of the wheel rest surface 42 where they intersect with the side surfaces 28 and 29. Similarly, the inclined surface 50 of the incline component 24 may also have lips 80 on each side to assist in guiding a vehicle wheel into the center of the incline component 24.

Although preferred embodiments of the disclosure are illustrated and described in connection with particular features, they can be adapted for use with a variety of ramps. Other embodiments and equivalent ramps, interlocking means and structures are envisioned within the scope of the claims. Various features of the disclosure have been particularly shown and described in connection with illustrated embodiments. However, it must be understood that the particular embodiments merely illustrate and that the invention is to be given its fullest interpretation within the terms of the claims.

What is claimed is:

1. A service ramp for raising a vehicle wheel, the ramp comprising an incline component and a separate but interlockable elevated wheel support component;

the elevated wheel support component including a top surface, side surfaces, a rear surface, and an interlocking portion, which includes interlocking members on a front face of the support component, wherein the top surface of the elevated wheel support component includes a wheel stop adjacent to the rear surface extending above a wheel rest surface, and a chock that has at least a section that moves above the wheel rest surface; and the incline component includes an inclined surface, side surfaces, and an interlocking portion including interlocking members on a rear face of the inclined component that are complementary to the interlocking members of the elevated wheel support component with the interlocking members being shaped to matingly interlock;

wherein one of the interlocking members does not extend the entire height of the corresponding interlocking portion;

wherein the elevated wheel support component and the incline component removably interlock when the interlocking member of the elevated wheel support component cooperates with the interlocking member of the incline component;

wherein the incline component can be removed while the vehicle wheel is resting on the elevated wheel support component.

2. The ramp of claim 1 wherein the interlocking members of the elevated wheel support component are pins and the interlocking members of the incline component are grooves, wherein the pins and grooves are longitudinally aligned when the components are interlocked.

3. The ramp of claim 1 wherein each side surface has a handle in a recessed portion.

4. The ramp of claim 3 wherein the recessed portion includes an inner wall.

5. The ramp of claim 1 wherein the ramp is made of a durable thermal plastic.

6. The ramp of claim 5 wherein the wheel stop is integrally molded into the elevated wheel support component.

7. The ramp of claim 1 wherein the incline component has a tapered thin edge at a distal end and further comprises a mat adjacent to the tapered thin edge.

8. The ramp of claim 7 wherein the mat is pivotally attached to the tapered thin edge of the incline component to pivot and extend away from the incline component.

9. The ramp of claim 1 wherein the chock can pivot above the wheel rest surface.

10. The ramp of claim 9 wherein the chock automatically pivots above the wheel rest surface when the incline component is separated from the elevated wheel support component.

11. The ramp of claim 1 wherein the chock can slide above the wheel rest surface.

12. The ramp of claim 11 wherein the chock automatically slides above the wheel rest surface when the incline component is separated from the elevated wheel support component.

13. The ramp of claim 1 wherein the side surfaces of the incline component have a handle in a recessed portion and wherein an inner recessed wall of the recessed portion is closer to a center of the inclined surface.

14. The ramp of claim 1 wherein the side surfaces of the elevated wheel support component have a handle in a recessed portion and wherein an inner recessed wall of the recessed portion is closer to a preferred load area of the wheel rest surface.

15. A plastic service ramp for raising a vehicle wheel, the ramp consisting essentially of an incline component and a separate but interlockable elevated wheel support component;

the elevated wheel support component including a top surface, side surfaces, a rear surface, and an interlocking portion, which includes interlocking members on a front face of the support component, wherein the top surface of the elevated wheel support component includes an integral wheel stop adjacent to the rear surface extending above a wheel rest surface, and a chock that is permanently attached to the wheel rest surface but has at least a section that moves above the wheel rest surface, the chock being adjacent to the interlocking portion of the elevated wheel support; and the incline component includes an inclined surface, side surfaces, and an interlocking portion including interlocking members on a rear face of the inclined component that are complementary to the interlocking members of the elevated wheel support component with the interlocking members being shaped to matingly interlock;

wherein one of the interlocking members does not extend the entire height of the corresponding interlocking portion;

wherein the elevated wheel sport component and the incline component removably interlock when the interlocking member of the interlocking portion of the elevated wheel support component cooperates with the interlocking member of the interlocking portion of the incline component;

wherein the incline component can be removed while the vehicle wheel is resting on the elevated wheel support component.

* * * * *

UNITED STATES PATENT AND TRADEMARK OFFICE

CERTIFICATE OF CORRECTION

PATENT NO. : 7,104,524 B1
APPLICATION NO. : 11/276018
DATED : September 12, 2006
INVENTOR(S) : David E. Hidding et al.

It is certified that error appears in the above-identified patent and that said Letters Patent is hereby corrected as shown below:

In column 8, line 1, please change “sport” to --support--.

Signed and Sealed this

Fifth Day of August, 2008

JON W. DUDAS
*Director of the United States Patent and Trademark Office*